United States Patent [19]

Ventimiglia

[11] Patent Number: 5,044,630

[45] Date of Patent: Sep. 3, 1991

[54] PORTABLE EXERCISE DEVICE

[76] Inventor: Stephen Ventimiglia, 28830 E. King William, Farmington Hills, Mich. 48331

[21] Appl. No.: 633,759

[22] Filed: Dec. 26, 1990

[51] Int. Cl.[5] ..... A63B 21/008; A63B 21/00; A63B 21/05; A63B 21/02

[52] U.S. Cl. ..... 272/130; 272/135; 272/141; 272/143; 272/137

[58] Field of Search ..... 272/126, 130, 135, 137, 272/141-143

[56] References Cited

U.S. PATENT DOCUMENTS

| | | | |
|---|---|---|---|
| 3,174,343 | 3/1965 | Kasulis | 73/379 |
| 3,471,145 | 10/1969 | Berger | 272/79 |
| 4,066,259 | 1/1978 | Brentham | 272/94 |
| 4,258,913 | 3/1981 | Brentham | 272/67 |
| 4,333,645 | 6/1982 | Wu | 272/130 |
| 4,606,538 | 8/1986 | Wang | 272/72 |
| 4,720,100 | 1/1988 | Du Buy | 272/134 |
| 4,772,016 | 9/1988 | Manion | 272/130 |
| 4,799,672 | 1/1989 | Barrett | 272/123 |
| 4,861,022 | 8/1989 | Boateallre | 272/137 |

FOREIGN PATENT DOCUMENTS

| | | | |
|---|---|---|---|
| 1012574 | 6/1977 | Canada | 272/141 |

*Primary Examiner*—Richard J. Apley
*Assistant Examiner*—Karen G. Horowitz
*Attorney, Agent, or Firm*—Basile and Hanlon

[57] ABSTRACT

The present invention comprises a portable exercise device comprising a mechanism for resisting longitudinal displacement of a user's hands, as well as a mechanism for resisting longitudinal displacement of a user's elbows. The device has two handles, with each of the handles being joined to the hand displacement resisting mechanism. The device further comprises two elbow pads, with each of the elbow pads being joined to the elbow displacement resisting mechanism. A user's forearms are laterally positioned between each handle and each elbow pad.

11 Claims, 1 Drawing Sheet

PORTABLE EXERCISE DEVICE

BACKGROUND OF THE INVENTION

1. Field of the Invention

The present invention generally relates to exercise devices, and more particularly, to such a device which is portable and works the muscles of the upper body.

2. Description of the Relevant Art

In recent years, there has been a substantial increase in health consciousness. People of all ages now wish to look and feel healthy, trim and fit. As a result of this, there is an increased need for various exercise equipment. Any such equipment involving weights or some type of resistance is especially popular, due to the increased benefits derived from working against such resistance.

The use of weights or resistance devices in a workout has been found to quickly tone and develop muscles, as well as provide great aerobic benefits. However, there are several problems inherent in the use of weight equipment. This equipment is often very expensive, space consuming and immobile. For these reasons, many people resort instead to exercises such as jogging, walking and bicycling. Yet these people also would like to enjoy the added benefit obtained from working out with equipment offering resistance.

Consequently, it would be desirable to provide a more economical, mobile, easily stored exercise device which can tone and define a user's upper body.

SUMMARY OF THE INVENTION

The present invention comprises a portable exercise device comprising means for yieldingly resisting longitudinal displacement of a user's hands, as well as means for yieldingly resisting longitudinal displacement of a user's elbows. The device has two handles and means for joining each of the handles to the hand displacement resisting means. The device further comprises two elbow pads and means for joining each of the elbow pads to the elbow displacement resisting means. Further, means, disposed between each handle and each elbow pad, are provided for laterally positioning a user's forearms.

BRIEF DESCRIPTION OF THE DRAWINGS

Various features and advantages of the present invention will become apparent to those skilled in the art after reference to the following detailed description and drawings, in which.

DESCRIPTION OF THE PREFERRED EMBODIMENT

Figure 1:
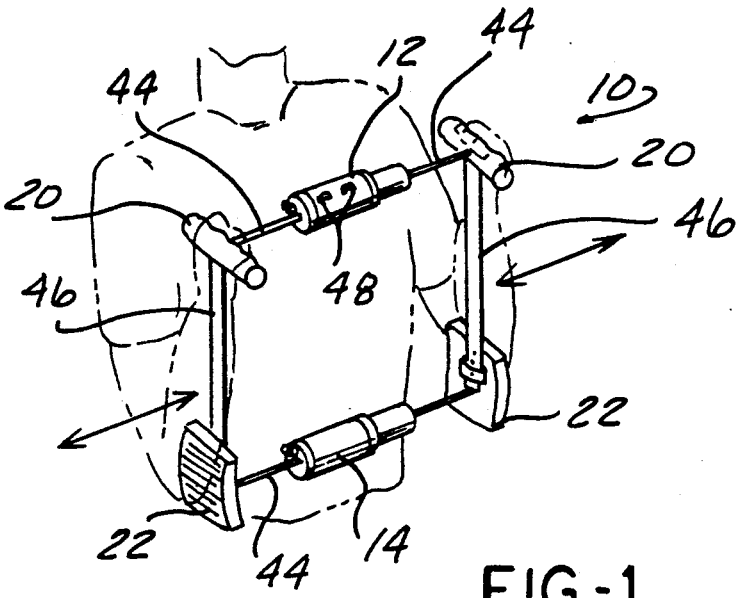
FIG. 1 is a perspective view of the portable exercise device of the present invention showing a user's upper body in phantom.

Referring now to FIG. 1, the portable exercise device of the present invention is designated generally as 10. Exercise device 10 comprises means for resisting longitudinal displacement of a user's hands. Means are also provided for resisting longitudinal displacement of a user's elbows. Both of these longitudinal displacement means may comprise any suitable means such as a pneumatic pump, gas resistance, weights, and the like. These two displacement resisting means may be comprised of the same or similar apparatus, or they may be two different displacement resisting means. In the preferred embodiment, both the hand displacement resisting means and the elbow displacement resisting means comprise an air cylinder 12, 14, respectively.

Each cylinder 12, 14 further comprises an inner tube 16 having an inner end and an outer end. An outer tube 18 has an outer end and an inner surface, with the outer tube 18 being in telescoping relationship with inner tube 16. In order to function properly, the outer ends of inner and outer tubes 16, 18 should be closed. The cylinders are constructed such that they cannot be pulled apart when in the outstretched mode. Depending upon where the cylinder 12, 14 is located, either of handles 20 or elbow pads 22 are connected to the outer ends of the two tubes 16, 18. Handles 20 and elbow pads 22 are but one of many possible moving means conventionally known in the art, and it is to be understood that any of these suitable means may be used in accordance with the present invention. Means 24 are provided on the inner end of inner tube 16 for slidably and sealingly engaging the inner surface of outer tube 18. Sliding and sealing means 24 forms a hermetic transverse barrier at the inner end of inner tube 16, whereby sliding and sealing means 24 forms, in conjunction with outer tube 18, a closed elongated cavity 26 containing air that is compressed when tubes 16, 18 are urged toward telescoped position and which is attenuated when tubes 16, 18 are urged toward outstretched position.

Figure 2:
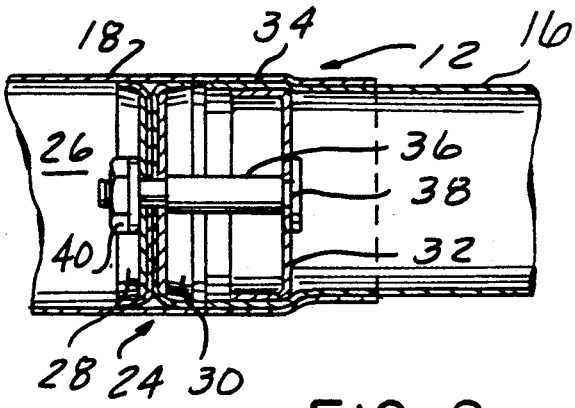
FIG. 2 is an enlarged, cut-away cross sectional view of one of the cylinders shown in FIG. 1.

The sliding and sealing means 24, particularly shown in FIG. 2, comprises two cup washers 28, 30 facing outwardly in opposite directions. Each cup washer 28, 30 includes a base whose periphery has an integral upstanding unbroken flange. Cup washers 28, 30 are made of flexible material which, when slid along the inner surface of a tube, rim foremost and in rubbing engagement with the tube, will form a sliding and sealing fit therewith. This material may comprise any suitable flexible material, but in the preferred embodiment this material is leather.

Sliding and sealing means 24 is supported by a metal cup 32 having a base and a circular upstanding peripheral flange which is force-fitted within the enlarged diameter section 34 of inner tube 16 The center of the base of cup 32 is formed with an aperture. A rod 36 has an end 38 of reduced diameter which is snugly fitted in the aperture. Rod 36 extends from cup 32 toward the outer end of outer tube 18. The free end of rod 36 has a 10 slender stem with a threaded free end for receiving a nut 40. The stem carries a structure that slidingly and sealingly engages the inner surface of outer tube 18. It is to be understood that many suitable structures, aside from the cup washers earlier described, may be employed for this purpose. For instance, the structure may constitute a piston having O-rings that slidingly and sealingly engage the inner surface of outer tube 18.

Figure 3:
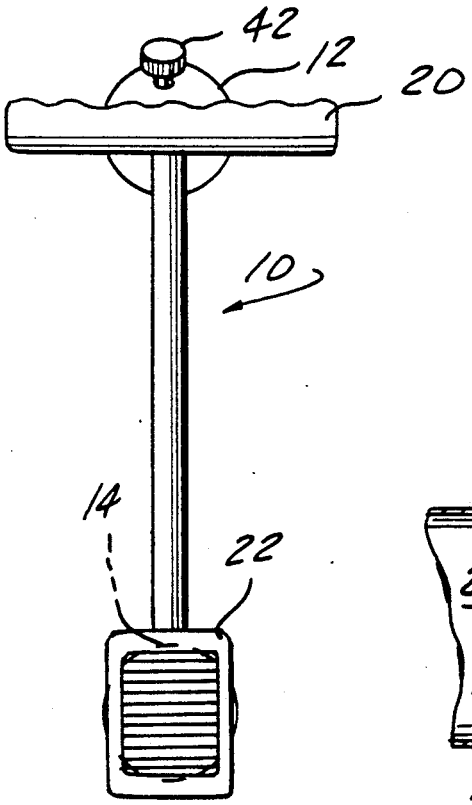
FIG. 3 is an enlarged side view of the present invention.

The cylinder 12, 14 may further comprise means for restricting flow in order to enable air to flow into or out of cavity 26 as may be desired in order to approximately level out, at some desired value, the resistance offered by the exerciser to either telescoping or extending movement. This restricted flow means or tensioning means may comprise a tension screw 42 as best seen in FIG. 3. This tension screw 42 is conventionally known in the art. The restricted flow means may also comprise an oppositely acting pair of double acting (that is, substantially free flow in one direction and restricted flow in the opposite direction) valves which are selectively rendered effective. The pair of valves (not shown) is selectively insertable into a passageway (not shown) extending between elongated cavity 26 to the ambient atmosphere. Each of the valves permits air to flow freely in one direction and under restriction in the opposite direction, the valves being in reversed orientation so that one valve, when effective, allows air to flow freely out of cavity 26 and restricts flow of air into cavity 26. The other valve, when effective, allows air to flow freely into cavity 26 and restricts flow of air out of cavity 26.

Portable exercise device 10 further comprises means for joining each of the handles 20 to the hand displacement resisting means. Further, means are provided for joining each of elbow pads 22 to the elbow displacement resisting means. Each of these joining means may comprise any suitable means such as rope or the like attached by a suitable attaching means to the outer ends of the cylinder and to either the handles or the elbow pads. In the preferred embodiment, this joining means is a rod 44 formed of a suitably rigid material. Each of rods 44 has two ends, with one end being fixedly attached to either a handle 20 or an elbow pad 22, with the other end being fixedly attached to one of the outer ends of one of the cylinders 12, 14. This means for fixedly attaching rod 44 can be any suitable means conventionally known in the art, such as using epoxy glue or the like.

The exercise device 10 further comprises means, disposed between each handle 20 and each elbow pad 22, for laterally positioning a user's forearms. This lateral positioning means may comprise any suitable means, but in the preferred embodiment, this means comprises two bars 46, each having a proximate and a distal end, with each of the proximate ends attached to one of the handles 20, and each of the distal ends being attached to one of the elbow pads 22.

Figure 4:
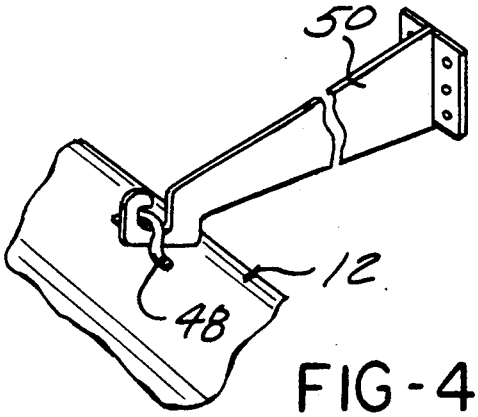
FIG. 4 is an enlarged cut-away perspective view showing one of the removable mounting means of the present invention.

Means are provided for removably mounting device 10 to a wall (not shown). This mounting means may comprise any suitable means conventionally known in this or a related art, but in the preferred embodiment, the removable mounting means comprises an eye 48 attached to the hand displacement resisting means, as best seen in FIG. 4. A bracket 50 has a first and a second end, with the first end being secured to the wall by a suitable securing means. The second end is configured so as to be selectively receivable within eye 48. As shown in FIG. 4, the force of gravity would keep exercise device 10 from falling off bracket 50. Yet, it would be a simple matter to remove it—a user would simply have to push device 10 toward the wall and then upwards in order to dislodge the second end of bracket 50 from eye 48. As shown in FIG. 1, two such eyes 48 are fixedly attached to cylinder 12, and two brackets 50 would be used to be received within these two eyes 48. It is to be understood that this is merely one example of many possible removable mounting means. In addition, it is to be further understood that one of the novel aspects of the present invention is that the exercise device may also be used without any mounting means at all, that is, with the exerciser portably supporting the weight of device 10 during workouts with the device.

The present invention tones and defines all of the major muscles of the upper body, especially all the different areas of the chest. To a somewhat lesser extent, device 10 works the shoulders and the back muscles. However, one of the benefits of the present invention is that a workout with the device 10 affords a lesser chance of injury to the back muscles than other conventionally known upper body exercise apparatus. One of the advantageous aspects of this invention is that since a displacement resisting means is located between each of the handles 20 and the elbow pads 22, an exerciser may, if desired, uniformly move the forearms in and out without pushing either the hands or the elbows in or out at an undesirable angle, which angle could, in some instances, cause discomfort and/or injury to the user's muscles. Since device !0 can be portable, the angle of the device during use, relative to the exerciser, may be varied. For example, the normal angle is shown in FIG. 1. There, the device is perpendicular to a plane running through the middle of the user's nose, which plane divides the user's body in half, each half being a mirror image of the other. When the device is portable, the device may be rotated relative to that plane such that the use angle is no longer perpendicular to the plane. The user may exercise at any such desired angle that is comfortable to him. As a further advantage, the use of two displacement resisting means provides better balanced stress points, thereby giving a more even distribution of resistance.

It is to be understood that the foregoing description is merely exemplary and not limitative, and the true scope of the invention is that defined in the following claims.

What is claimed is:

1. A portable exercise device, comprising:

means for yieldingly resisting longitudinal displacement of a user's hands;

means for yieldingly resisting longitudinal displacement of a user's elbows spaced apart from said hand displacement resisting means;

two handles;

means positioned between the handles for joining each of the handles to the hand displacement resisting means;

two elbow pads;

means positioned between the elbow pads for joining each of the elbow pads to the elbow displacement resisting means; and means, disposed between each handle and each elbow pad, for laterally positioning a user's forearms.

2. The portable exercise device as defined in claim 1, further comprising means for adjusting tension in each of the resisting means.

3. The portable exercise device as defined in claim 2 wherein the adjusting means comprises a tensioning screw.

4. The portable exercise device as defined in claim 1 wherein the hand displacement resisting means comprises a cylinder.

5. The portable exercise device as defined in claim 4 wherein the cylinder further comprises:

an inner tube having an inner end and an outer end;

an outer tube having an outer end and an inner surface, the outer tube being in telescoping relationship with the inner tube, wherein the handles are connected to the outer ends of the two tubes;

means on the inner end of the inner tube for slidably and sealingly engaging the inner surface of the outer tube; and means for closing the outer end of the outer tube to form an elongated cavity in which a column of air is compressed and expanded as the handles are moved toward and away from one another in, respectively, a compression and a tension mode.

6. The portable exercise device as defined in claim 1 wherein the elbow displacement resisting means comprises a cylinder.

7. The portable exercise device as defined in claim 6 wherein the cylinder further comprises:

an inner tube having an inner end and an outer end;

an outer tube having an outer end and an inner surface, the outer tube being in telescoping relationship with the inner tube, wherein the elbow pads are connected to the outer ends of the two tubes;

means on the inner end of the inner tube for slidably and sealingly engaging the inner surface of the outer tube; and means for closing the outer end of the outer tube to form an elongated cavity in which a column of air is compressed and expanded as the elbow pads are moved toward and away from one another in, respectively, a compression and a tension mode.

8. The portable exercise device as defined in claim 1 wherein the lateral positioning means comprises two bars each having a proximate and a distal end, each of the proximate ends attached to one of the handles, each of the distal ends attached to one of the elbow pads.

9. The portable exercise device as defined in claim 1, further comprising means for removably mounting the device to a wall.

10. The portable exercise device as defined in claim 9 wherein the removable mounting means comprises:

an eye attached to the hand displacement resisting means; and a bracket having a first and a second end, the first end being secured to the wall, the second end configured so as to be selectively receivable within the eye.

11. A portable exercise device, comprising:

two handles;

two elbow pads;

a first cylinder positioned between the handles for yieldingly resisting longitudinal displacement of a user's hands;

a second cylinder for yieldingly resisting longitudinal displacement of a user's elbows, each of the first and second cylinders comprising:

an inner tube having an inner end and an outer end;

an outer tube having an outer end and a inner surface, the outer tube being in telescoping relationship with the inner tube, wherein either of the handles and the elbow pads are connected to the outer ends of the two tubes;

means on the inner end of the inner tube for slidably and sealingly engaging the inner surface of the outer tube; and means for closing the outer end of the outer tube to form an elongated cavity in which a column of air is compressed and expanded as either of the handles and the elbow pads are moved toward and away from one another in, respectively, a compression and a tension mode;

means for joining each of the handles to the first cylinder;

means for joining each of the elbow pads to the second cylinder;

two bars for laterally positioning a user's forearms, each of the bars having a proximate and a distal end, each of the proximate ends attached to one of the handles, each of the distal ends attached to one of the elbow pads; and means for adjusting tension in each of the first and second cylinders.

* * * * *